US007267584B1

(12) United States Patent
Liu

(10) Patent No.: US 7,267,584 B1
(45) Date of Patent: Sep. 11, 2007

(54) RJ-45 SOCKET MODULE AND INTERNAL CIRCUITRY

(75) Inventor: Lu-Ta Liu, Taipei (TW)

(73) Assignee: Lankom Electronics Co., Ltd., Taipei (TW)

( * ) Notice: Subject to any disclaimer, the term of this patent is extended or adjusted under 35 U.S.C. 154(b) by 0 days.

(21) Appl. No.: 11/391,530

(22) Filed: Mar. 28, 2006

(51) Int. Cl.
*H01R 24/00* (2006.01)

(52) U.S. Cl. ..... 439/676

(58) Field of Classification Search ..... 439/676, 439/541.5, 620, 490, 941, 76.1
See application file for complete search history.

(56) References Cited

U.S. PATENT DOCUMENTS 5,736,910 A * 4/1998 Townsend et al. ..... 333/181
6,773,302 B2 * 8/2004 Gutierrez et al. ..... 439/541.5
6,835,098 B1 * 12/2004 Chang ..... 439/620.06
7,040,926 B2 * 5/2006 Ferentz ..... 439/676
7,040,927 B1 * 5/2006 Liu ..... 439/490

* cited by examiner

*Primary Examiner*—J. F. Duverne
(74) *Attorney, Agent, or Firm*—William E. Pelton, Esq.; Cooper & Dunham LLP

(57) ABSTRACT

An RJ-45 socket module has a socket chassis, a circuit board, a transformer, a pin assembly, multiple lighting units, a base and a chassis cover. The circuit board is mounted in the socket chassis and has multiple through holes, printed circuit, multiple resistors, a capacitor and multiple contacts. The contacts are formed on the circuit board with Surface-Mount Technology (SMT), and each contact is separated from adjacent printed circuit by a distance. The pin assembly is attached to the contacts on the circuit board and has a holder and multiple pins. The pins are connected to the contacts on the circuit board with SMT. The base is mounted under the circuit board and has a seat, a first lead assembly and a second lead assembly. The first lead assembly and the second lead assembly are mounted on the seat and have multiple leads.

17 Claims, 6 Drawing Sheets

RJ-45 SOCKET MODULE AND INTERNAL CIRCUITRY

BACKGROUND OF THE INVENTION

1. Field of the Invention

The present invention relates to an RJ-45 socket, and more particularly to an RJ-45 socket module to prevent surges resulting from electrical arcing and an internal circuitry.

2. Description of Related Art

RJ-45 sockets module connect to ports or interfaces in electrical appliances such as computers. A conventional RJ-45 socket module comprises a socket chassis, a circuit board and a pin assembly.

The circuit board is mounted in the socket chassis and has circuitry and multiple through holes. Each through hole has a diameter and is separated from adjacent circuitry by a distance. The distance between through holes and adjacent circuitry is very short because the diameter of each through hole cannot be changed.

The pin assembly passes through the through holes in the circuit board to provide multiple contacts mounted on the circuit board. When the RJ-45 connector is plugged into the RJ-45 socket module, electrical arcing may occur because the contacts often have high voltage, circuitry on the circuit board often has low voltage and the distance between the contacts and the circuitry is very short. The electrical arcing causes electrical surges that may damage an attached appliance or the RJ-45 connector. Consequently, surge suppressors are often added to prevent damage to attached appliances.

To overcome the shortcomings, the present invention provides an RJ-45 socket and an internal circuitry to mitigate or obviate the aforementioned problems.

SUMMARY OF THE INVENTION

The main objective of the invention is to provide an RJ-45 socket module to prevent electrical surges resulting from arcing inside the RJ-45 socket module.

An RJ-45 socket module in accordance with the present invention comprises a socket chassis, a circuit board, a transformer, a pin assembly, multiple lighting units, a base and a chassis cover. The circuit board is mounted in the socket chassis and has multiple through holes, printed circuit, multiple resistors, a capacitor and multiple contacts. The contacts are formed on the circuit board with Surface-Mount Technology (SMT), and each contact is separated from adjacent printed circuit by a distance. The pin assembly is attached to the contacts on the circuit board and comprises a holder and multiple pins. The pins are connected to the contacts on the circuit board with SMT. The base is mounted under the circuit board and comprises a seat, a first lead assembly and a second lead assembly. The first lead assembly and the second lead assembly are mounted on the seat and comprise multiple leads.

Other objectives, advantages and novel features of the invention will become more apparent from the following detailed description when taken in conjunction with the accompanying drawings.

DETAILED DESCRIPTION OF PREFERRED EMBODIMENT

Figure 1:
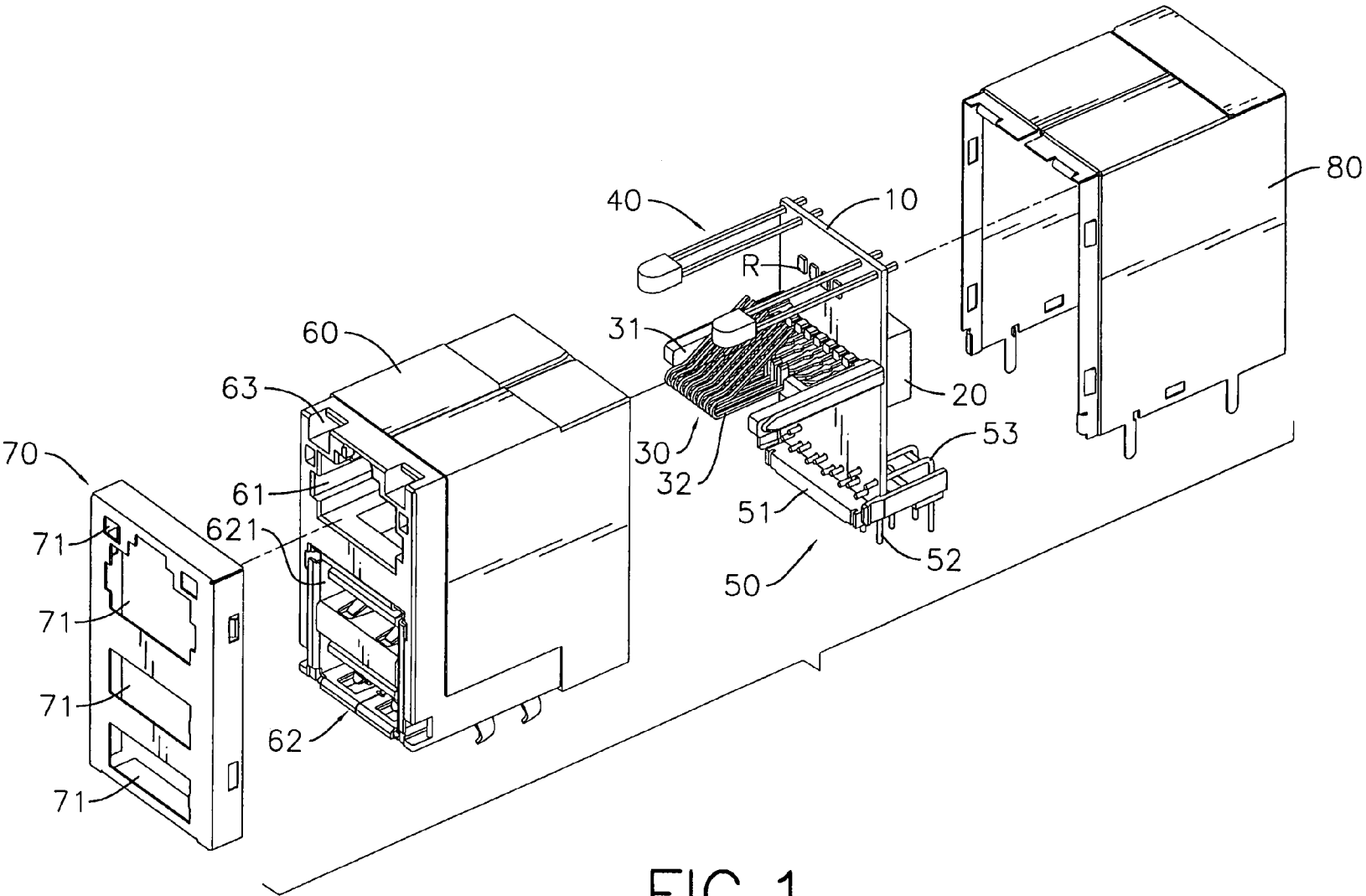
FIG. 1 is an exploded perspective view of an RJ-45 socket module in accordance with the present invention.
Figure 2:
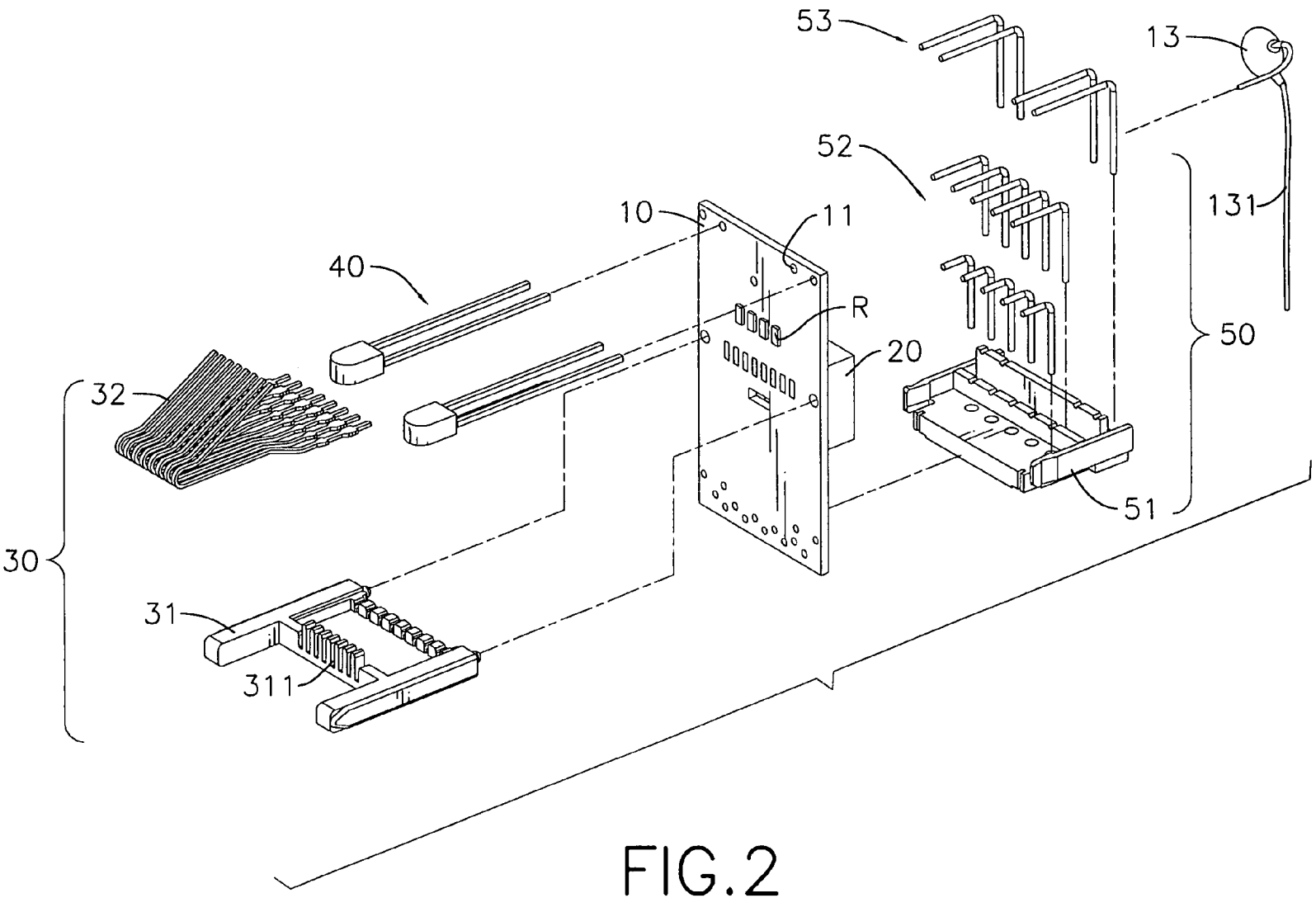
FIG. 2 is an exploded perspective view of a circuit board, a pin assembly, multiple lighting units and a base in the RJ-45 socket module in FIG. 1.

With reference to FIGS. 1 and 2, an RJ-45 socket module in accordance with the present invention comprises a socket chassis (60), a circuit board (10), a transformer (20), a pin assembly (30), multiple lighting units (40), a base (50), optional insulating encapsulant, an optional Universal Serial Bus (USB) module (62), optional electrical tape, a front cover (70) and a chassis cover (80).

The socket chassis (60) has a front, an open rear, a top, an internal cavity (not shown), at least one RJ-45 socket recess (61), an optional USB module recess and multiple channels (63). The at least one RJ-45 socket recess (61) is formed through the front of the socket chassis (60), communicates with the internal cavity and has a shape corresponding to an RJ-45 connector (not shown). The USB module recess is formed through the front of the socket chassis (60) below the at least one RJ-45 socket recess (61) and communicates with the internal cavity. The channels (63) are formed through the front of the socket chassis (60) near the top and communicate with the internal cavity.

Figure 4:
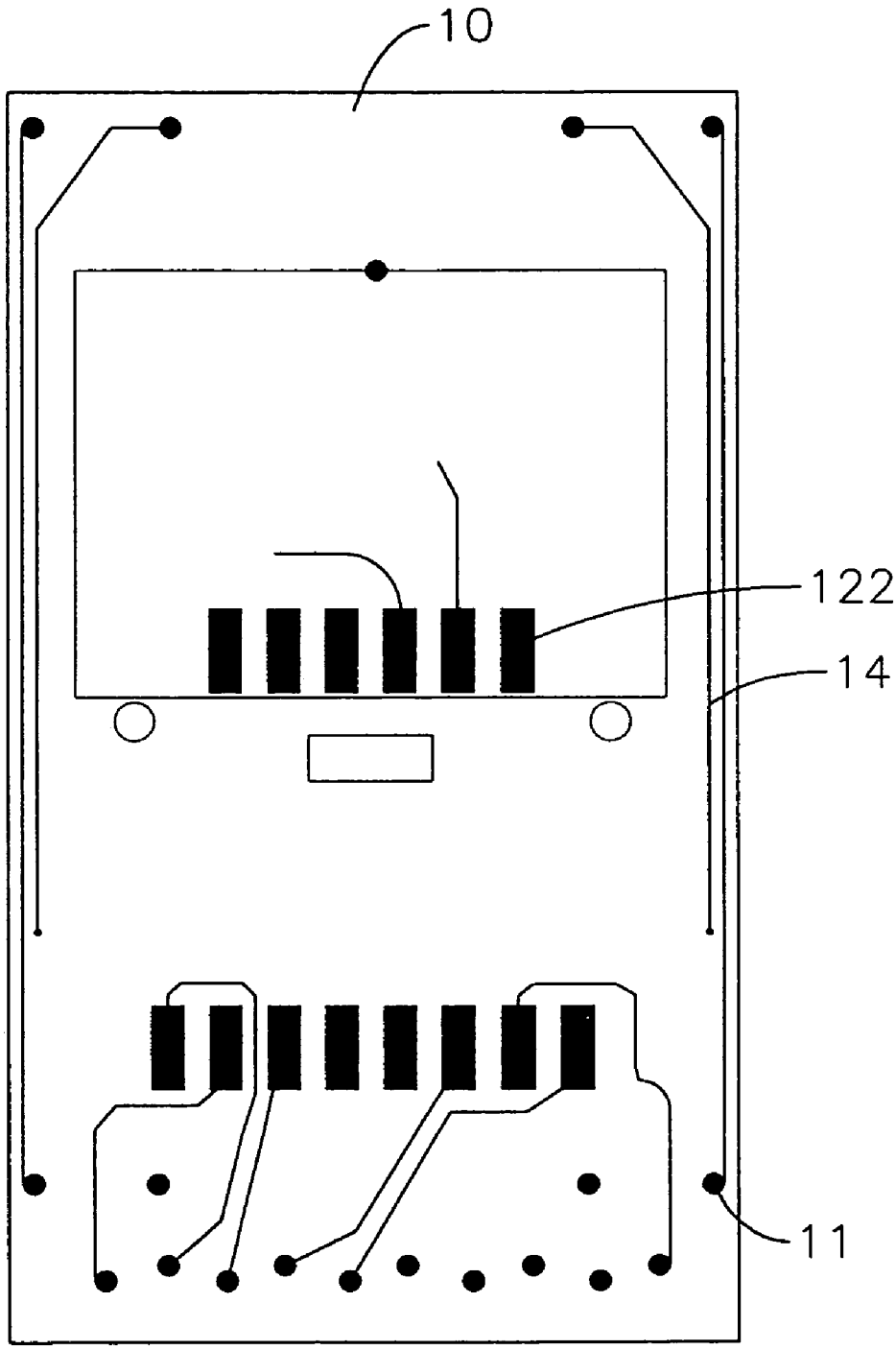
FIG. 4 is a front view of a circuit board in the RJ-45 socket module in FIG. 1.

With further reference to FIG. 4, the circuit board (10) is mounted in the internal cavity and has a front, a rear, two side edges, a top, a bottom, multiple through holes (11), printed circuit (14), multiple resistors (R), a capacitor (13) and multiple contacts (12).

The printed circuit (14) is formed on the front and rear of the circuit board (10).

The resistors (R) are mounted on the front of the circuit board (10).

Figure 3:
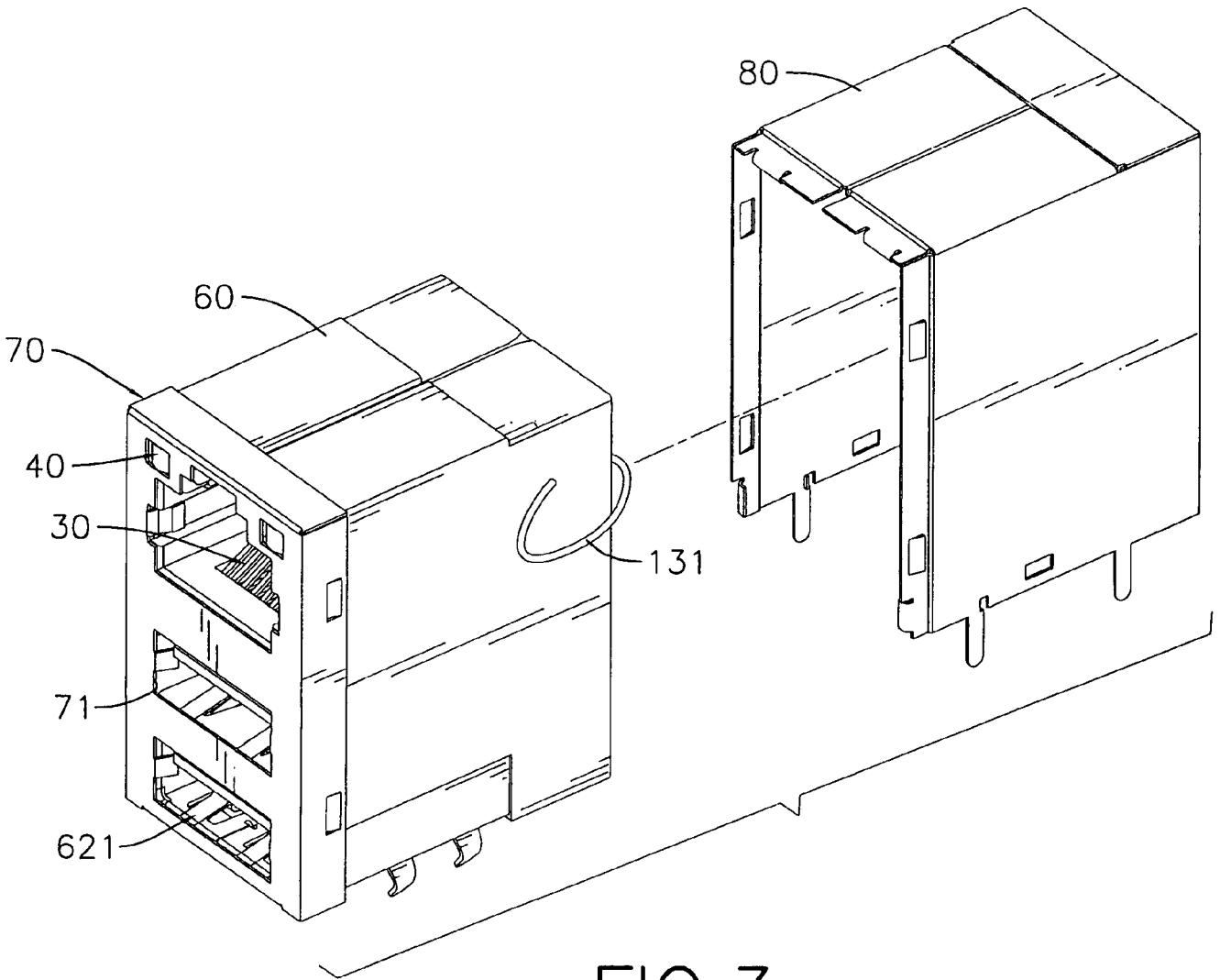
FIG. 3 is an exploded perspective view of the RJ-45 socket module in FIG. 1 with a pin wound and mounted outside the socket chassis.

The capacitor (13) is mounted on the rear of the circuit board (10), has two pins (131) and may be a 2200 pF (3500V) capacitor. With further reference to FIG. 3, one of the pins (131) may be wound around and mounted outside the socket chassis (60).

With further reference to FIG. 4, the contacts (12) are formed on the front of the circuit board (10) with Surface-Mount Technology (SMT), and each contact (12) is separated from adjacent printed circuit (14) by a distance. The distance may be more than 3.75 mm and is wide enough to keep electrical arcing occurring between the contacts (12) and adjacent printed circuit (14).

Figure 5:
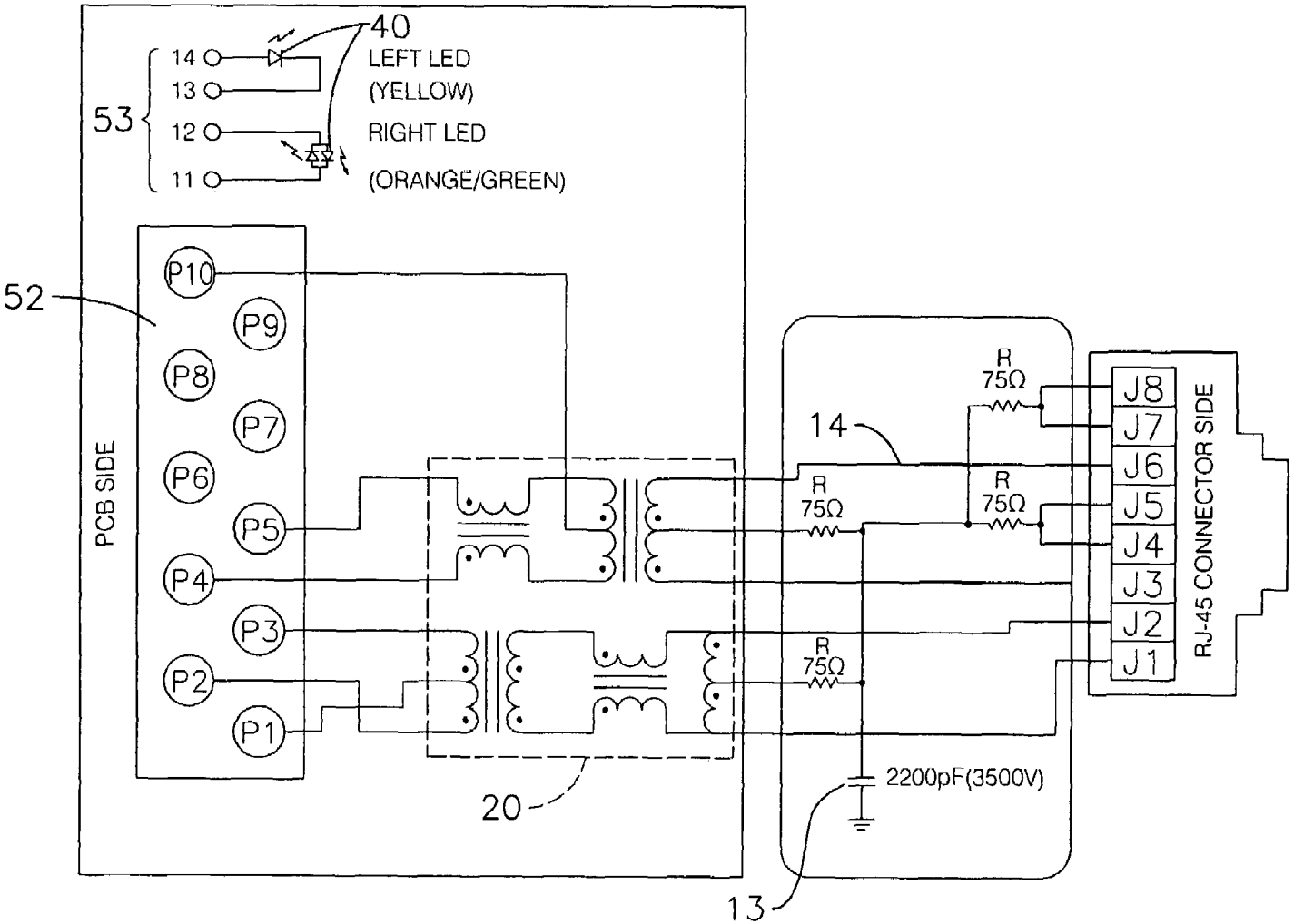
FIG. 5 is a circuit diagram of a first embodiment of an internal circuitry in the RJ-45 socket module in FIG. 1.
Figure 6:
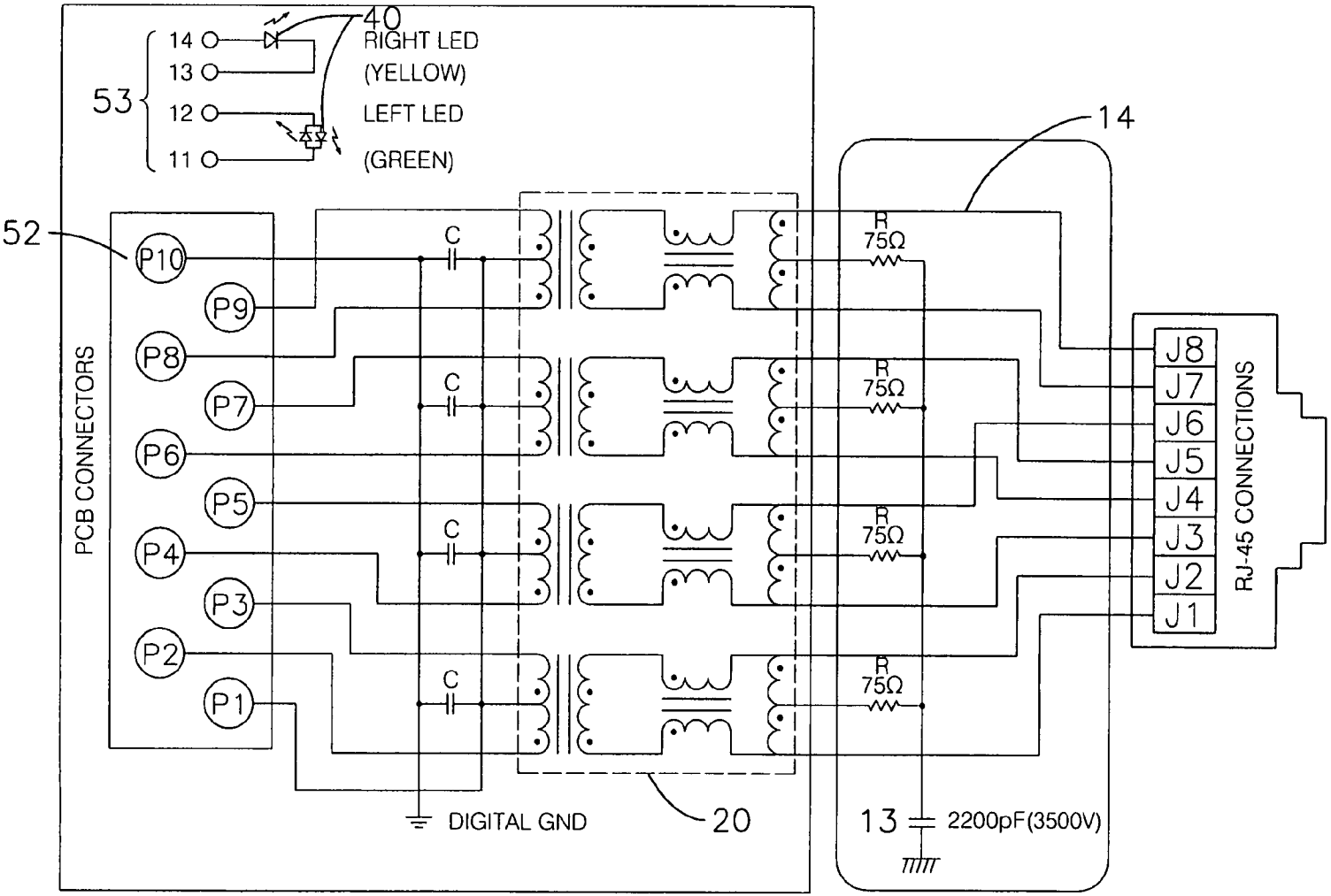
FIG. 6 is a circuit diagram of a second embodiment of an internal circuitry in the RJ-45 socket module in FIG. 1.

With further reference to FIGS. 5 and 6, the transformer (20) is mounted on the rear of the circuit board (10) and may have two or four pairs of coils with each pair having a primary winding and a secondary winding.

The pin assembly (30) is attached to and protrudes from the contacts (12) on the front of the circuit board (10), protrudes into the RJ-45 socket recess (61) and comprises a holder (31) and multiple pins (32).

The holder (31) is mounted on and protrudes from the front of the circuit board (10), protrudes into the RJ-45 socket recess and has multiple notches (311).

The pins (32) are connected to the contacts (12) on the front of the circuit board (10) with SMT, selectively connected to an RJ-45 connector and are mounted respectively in the notches (311) in the holder (31).

The lighting units (40) may be LEDs having pins, are mounted on the front of the circuit board (10) and in the channels (63) and are visible in the channels (63) through the front of the socket chassis (60).

The base (50) is mounted on the bottom of the circuit board (10) and comprises a seat (51), a first lead assembly (52) and a second lead assembly (53).

The first lead assembly (52) is mounted on the seat (51) and has multiple leads. Each lead has an outer end and an inner end. The outer end is mounted in the seat (51), and the inner end passes through a corresponding through hole (11) in the circuit board (10).

The second lead assembly (53) is mounted on the seat (51) and has multiple leads. Leads of the second lead assembly (53) have an outer end and an inner end. The outer end is mounted in the seat (51), and the inner end passes through a corresponding through hole (11) in the circuit board (10) above leads in the first lead assembly (52).

The insulating encapsulant is applied to the circuit board (10) to improve insulation after mounting the transformer (20), the pin assembly (30), the lighting unit (40) and the seat (40) on the circuit board (10).

The USB module (62) is mounted in the USB module recess and has at least one USB socket (621).

The electrical tape is applied to the pins of the LEDs and the USB module (62) to improve insulation.

The front cover (70) is mounted on and covers the front of the socket chassis (60) and has multiple openings (71). The openings (71) correspond respectively to the at least one RJ-45 socket recess (61), the USB socket recess and the channels (63) in the socket chassis (60).

The chassis cover (80) encloses the socket chassis (60) and may be made of metal to be grounded through the capacitor (13).

With reference to FIG. 5, the primary winding of the transformer (20) is connected to the contacts (12) and the capacitor (13) through the printed circuit (14) and the resistors (R).

The first lead assembly (52) is connected to the secondary winding of the coils of the transformer (20) through the printed circuit (14) and optional capacitors (C).

The second lead assembly (53) is connected to the lighting units (40) through the printed circuit (14).

The RJ-45 socket module and the internal circuitry as described do not need a surge suppressor to eliminate surges because the distance between the contacts (12) and adjacent printed circuit (14) is wide enough to prevent electrical arcing.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. An RJ-45 socket module comprising:

a socket chassis having a front;

an open rear;

a top;

an internal cavity;

at least one RJ-45 socket recess being formed through the front of the socket chassis, communicating with the internal cavity and having a shape corresponding to an RJ-45 connector; and multiple channels being formed through the front of the socket chassis near the top and communicating with the internal cavity;

a circuit board being mounted in the internal cavity of the socket chassis and having a front;

a rear;

two side edges;

a top;

a bottom;

multiple through holes;

printed circuit being formed on the front and rear of the circuit board;

multiple resistors being mounted on the front of the circuit board;

a capacitor mounted on the rear of the circuit board and having two pins; and multiple contacts being formed on the front of the circuit board with Surface-Mount Technology (SMT), and each contact being separated from adjacent printed circuit by a distance;

a transformer being mounted on the rear of the circuit board;

a pin assembly being attached to and protruding from the contacts on the front of the circuit board, protruding into the RJ-45 socket recess and comprising a holder being mounted on and protruding from the front of the circuit board, protruding into the RJ-45 socket recess and having multiple notches; and multiple pins being connected to the contacts on the front of the circuit board with SMT and mounted respectively in the notches in the holder;

multiple lighting units being mounted on the front of the circuit board and in the channels and being visible through the front of the socket chassis;

a base being mounted on the bottom of the circuit board and comprising a seat; and a first lead assembly being mounted on the seat and having multiple leads, each lead having an outer end being mounted in the seat; and an inner end passing through a corresponding through hole in the circuit board; and a second lead assembly being mounted on the seat and having multiple leads, each lead having an outer end being mounted in the seat; and an inner end passing through a corresponding through holes I the circuit board;

a front cover being mounted on and covering the front of the socket chassis and having multiple openings corresponding respectively to the at least one RJ-45 socket recess and the channels in the socket chassis; and a chassis cover enclosing the socket chassis.

2. The RJ-45 socket module as claimed in claim 1, wherein the socket chassis further has a USB socket recess formed through the front of the socket chassis below the at least one RJ-45 socket recess and communicating with the internal cavity.

3. The RJ-45 socket module as claimed in claim 1, wherein one of the pins of the capacitor is wound around and mounted outside the socket chassis.

4. The RJ-45 socket module as claimed in claim 1, wherein the distance between the contacts and adjacent circuitry is more than 3.75 mm.

5. The RJ-45 socket module as claimed in claim 1, wherein the lighting units are LEDs having pins.

6. The RJ-45 socket module as claimed in claim 1 further comprising an insulating encapsulant applied to the circuit board after mounting the transformer, the pin assembly, the lighting unit and the seat on the circuit board.

7. The RJ-45 socket module as claimed in claim 2, wherein the RJ45 socket module further comprises a Universal Serial Bus (USB) module mounted in the USB module recess and having at least one US socket; and the multiple openings in the front cover further correspond to the USB socket recess.

8. The RJ-45 socket module as claimed in claim 5 further comprising electrical tape applied to the pins of the LEDs.

9. The RJ-45 socket module as claimed in claim 7 further comprising an electrical tape applied to the USB module.

10. The RJ-45 socket module as claimed in claim 3, wherein the chassis cover is made of metal to be grounded through the capacitor.

11. The RJ-45 socket module as claimed in claim 1, wherein the capacitor is a 2200 pF (3500V) capacitor.

12. The RJ-45 socket module as claimed in claim 2, wherein one of the pines of the capacitor is wound around and mounted outside the socket chassis.

13. The RJ-45 socket module as claimed in claim 12, wherein the distance between the contacts and adjacent circuitry is more than 3.75 mm.

14. The RJ-45 socket module as claimed in claim 13, wherein the lighting units are LEDs having pins.

15. The RJ-45 socket module as claimed in claim 14 further comprising an insulating encapsulant applied to the circuit board after mounting the transformer, the pin assembly, the lighting unit and the seat on the circuit board.

16. The RJ-45 socket module as claimed in claim 15, wherein the RJ-45 socket module further comprises a Universal Serial Bus (USB) module mounted in the USB module recess and having at least one USB socket; and the multiple openings in the front cover further correspond to the USB socket recess.

17. The RJ-45 socket module as claimed in claim 16 further comprising an electrical tape applied to the USB module.

* * * * *